US008028546B2

(12) United States Patent
Lonati et al.

(10) Patent No.: US 8,028,546 B2
(45) Date of Patent: Oct. 4, 2011

(54) PICK-UP DEVICE FOR PICKING UP A TUBULAR KNITTED ARTICLE FROM A CIRCULAR KNITTING MACHINE FOR HOSIERY OR THE LIKE AND FOR TRANSFERRING IT TO A UNIT ADAPTED TO PERFORM ADDITIONAL WORK ON THE ARTICLE

(75) Inventors: Ettore Lonati, Botticino (IT); Tiberio Lonati, Brescia (IT); Fausto Lonati, Brescia (IT)

(73) Assignee: Lonati S.p.A., Brescia (IT)

( * ) Notice: Subject to any disclaimer, the term of this patent is extended or adjusted under 35 U.S.C. 154(b) by 0 days.

(21) Appl. No.: 12/867,629

(22) PCT Filed: Feb. 20, 2009

(86) PCT No.: PCT/EP2009/052040

§ 371 (c)(1),
(2), (4) Date: Aug. 13, 2010

(87) PCT Pub. No.: WO2009/112347

PCT Pub. Date: Sep. 17, 2009

(65) Prior Publication Data

US 2010/0319408 A1 Dec. 23, 2010

(30) Foreign Application Priority Data

Mar. 10, 2008 (IT) ..... MI2008A0398

(51) Int. Cl.
*D04B 15/88* (2006.01)

(52) U.S. Cl. ..... 66/148

(58) Field of Classification Search ..... 66/169 S, 66/148, 59, 147, 149 R, 150, 152, 153, 13, 66/14, 17, 18, 8

See application file for complete search history.

(56) References Cited

U.S. PATENT DOCUMENTS 5,924,309 A * 7/1999 Conti ..... 66/149 S (Continued)

FOREIGN PATENT DOCUMENTS

EP 0 939 158 A2 1/1999

(Continued)

OTHER PUBLICATIONS

International Search Report and Written Opinion related to PCT/EP2009/052040.

*Primary Examiner* — Danny Worrell
(74) *Attorney, Agent, or Firm* — Husch Blackwell LLP

(57) ABSTRACT

A pick-up device for picking up a tubular knitted article from a circular knitting machine for hosiery and for transferring the article to a unit adapted to perform additional work thereon. The device comprises an annular pick-up body that supports pick-up members that can slide with respect to the pick-up body along radial directions. The pick-up body can be arranged coaxially around the needle cylinder of a circular knitting machine for hosiery so that each one of the pick-up members faces laterally a needle of the machine. The end of each one of the pick-up members that is directed toward the axis of the pick-up body has a seat that can engage a region of the stem of the needle that is arranged proximate to the latch of the needle on the opposite side with respect to the head of the needle. The device comprises actuation elements formed by elastic elements that act on the pick-up members for their sliding toward the axis of the pick-up body and radial pushers that act on the pick-up members for their sliding away from the axis of the pick-up body in contrast with the action of the elastic elements.

17 Claims, 16 Drawing Sheets

U.S. PATENT DOCUMENTS

| | | | | |
|---|---|---|---|---|
| 6,155,081 | A | 12/2000 | Frullini et al. | |
| 6,164,091 | A | 12/2000 | Frullini et al. | |
| 6,389,849 | B1 * | 5/2002 | Conti | 66/148 |
| 6,698,250 | B2 * | 3/2004 | Lonati et al. | 66/149 S |

FOREIGN PATENT DOCUMENTS

| | | | |
|---|---|---|---|
| EP | 0 942 086 | A2 | 9/1999 |
| WO | WO97/04153 | A1 | 2/1997 |

* cited by examiner

PICK-UP DEVICE FOR PICKING UP A TUBULAR KNITTED ARTICLE FROM A CIRCULAR KNITTING MACHINE FOR HOSIERY OR THE LIKE AND FOR TRANSFERRING IT TO A UNIT ADAPTED TO PERFORM ADDITIONAL WORK ON THE ARTICLE

TECHNICAL FIELD

The present invention relates to a pick-up device for picking up a tubular knitted article from a circular knitting machine for hosiery or the like and for transferring it to a unit adapted to perform additional work on the article.

BACKGROUND ART

In the field of the production of knitted tubular articles with circular knitting machines for hosiery or the like, in some cases it is necessary to transfer the article from the machine used to produce it to another production unit in order to perform on the article additional work that cannot be performed on said machine or that it is not economically convenient to perform on said machine.

In particular, in the field of the production of hosiery, in recent years techniques have been developed for automated toe closing by sewing or looping. Some of these techniques are based on picking up the article from the machine used to produce it and on transferring it to a station for further work, which is distinct with respect to the production machine, so as to close the toe of the hosiery item in the station for further work, while the machine is used to produce another hosiery item. These techniques have the advantage, with respect to other techniques based on closing the toe of the hosiery item directly on the machine used to produce it, of not penalizing excessively the productivity of the machine.

The transfer of the hosiery item, or more generally of the tubular article, from the machine used for its production to the station in which the closure of an axial end of the article, or more generally additional work, must be carried out, is generally performed by means of a pick-up device, which by means of pick-up members individually grips the loops of knitting of the article from the needles of the machine and retains them during the transfer of the article.

In some toe closing techniques, the pick-up device is also used to support the article during the execution of the additional work, while in other techniques the pick-up device is used exclusively to transfer the article, since once it has reached the station where the additional work is to be done it releases, usually again in an individual manner, the loops of knitting picked up previously from the needles to another device that is designed to support the article during execution of the additional work, such as for example a handling device. Such handling device arranges the loops that belong to one half of the row of knitting received from the pick-up device so that they face the loops that belong to the other half of said row of knitting and supports the two half-rows of knitting in a mutually facing position during the intervention of a sewing or looping head that joins the pairs of mutually facing loops of knitting.

In known types of pick-up devices used to simply transfer the article from the machine that produces it to a handling device, the coupling between the pick-up members and the needles, in order to transfer the loops of knitting from the needles to the pick-up members, usually occurs by inserting the head of the needle in a seat formed in the end of the pick-up member. For that reason, the pick-up device usually has an annular pick-up body, designed to face coaxially the end of the needle cylinder from which the heads of the needles protrude and which supports a plurality of pick-up members oriented parallel to the axis of the pick-up body.

A pick-up device of this type is disclosed for example in EP0942086.

In devices of this type, the coupling between one end of the pick-up members and the head of the corresponding needle requires high precision both in the provision of the pick-up device as a whole and in the positioning of the pick-up body with respect to the needle cylinder of the machine and of the pick-up members with respect to the needles.

Moreover, the arrangement of the pick-up members, as well as the presence of any members for actuating them, entails a relatively large space occupation of the pick-up body along a direction that is parallel to the axis thereof. This relatively large space occupation can cause problems in positioning the pick-up body with respect to the machine in order to pick up the article. In order to be able to arrange the pick-up body so that it faces the needle cylinder of the machine, in the case of single-cylinder circular machines, it is in fact necessary to lift the dial and the yarn guides that are used to provide the needles with the yarns required to manufacture the article. This lifting can cause tangling of the yarns and accordingly cause problems when knitting on the machine resumes.

If the pick-up device is used with double-cylinder circular machines, the problems generated by the axial space occupation of the pick-up body are even greater, since in this case the pick-up body must be arranged between the two needle cylinders by first lifting the entire upper needle cylinder and the members connected thereto.

DISCLOSURE OF THE INVENTION

The aim of the present invention is to solve the problems described above by providing a pick-up device for picking up a tubular knitted article from a circular knitting machine for hosiery or the like and for transferring it to a unit adapted to perform additional operations on the article, which can be provided in a relatively simple manner and can be coupled to the needles of the machine with excellent precision.

Within this aim, an object of the invention is to provide a pick-up device that can have a particularly limited axial space occupation, so as to simplify its positioning with respect to the machine used to produce the article when picking up the article.

Another object of the invention is to provide a pick-up device that can also obviate errors in the radial position of the needles of the machine used to produce the article.

Another object of the invention is to provide a device that ensures high reliability in operation.

This aim, as well as these and other objects that will become better apparent hereinafter, are achieved by a pick-up device for picking up a tubular knitted article from a circular knitting machine for hosiery or the like and for transferring the article to a unit adapted to perform additional work thereon, comprising an annular pick-up body that supports pick-up members that can slide with respect to said pick-up body along radial directions, said pick-up body being arrangeable coaxially around the needle cylinder of a circular knitting machine for hosiery or the like so that each one of said pick-up members faces laterally a needle of the machine; actuation means being provided which act on said pick-up members to move them toward or away from the axis of said pick-up body, for the engagement or disengagement of each pick-up member with the needle of the machine that it is made to face, and each of said pick-up members being adapted to pick up the loop of knitting retained on said needle, characterized in that the end of each one of said pick-up members that is directed toward the axis of said pick-up body has a seat that can engage a region of the stem of the needle that is arranged proximate to the latch of the needle on the opposite side with respect to the head of the needle, and in that said actuation means comprise elastic means that act on said pick-up members for their sliding toward the axis of said pick-up body and radial pushers that act on said pick-up members for their sliding away from the axis of said pick-up body in contrast with the action of said elastic means.

BRIEF DESCRIPTION OF THE DRAWINGS

Further characteristics and advantages of the invention will become better apparent from the description of a preferred but non-exclusive embodiment of the pick-up device according to the invention, illustrated by way of non-limiting example in the accompanying drawings, wherein:

FIG. 1 is a schematic axial sectional view of the pick-up device according to the invention, with its pick-up body arranged above and coaxially with respect to the needle cylinder of a circular knitting machine for hosiery or the like;

FIG. 3 is a schematic axial sectional view of the pick-up device according to the invention with its pick-up body lowered onto the knitting machine for hosiery or the like;

FIG. 5 is an axial sectional view of the pick-up body arranged around the needle cylinder of a machine used to manufacture the article prior to the engagement of the pick-up members with the needles of the machine;

FIG. 6 is an axial sectional view, similar to FIG. 5, of the engagement of the pick-up members with the needles of the machine;

FIG. 7 is an axial sectional view of the passage of the loops of knitting from the needles of the machine to the pick-up members;

FIG. 8 is an enlarged-scale side elevation view of a pick-up member of the pick-up device according to the invention, rested against the stem of a needle;

FIG. 9 is an enlarged-scale side elevation view of a pick-up member of the pick-up device according to the invention, coupled to the stem of a needle, during the passage of a loop of knitting from the needle to the pick-up member;

FIG. 10 is an enlarged-scale top plan view of a pick-up member of the pick-up device according to the invention, coupled to the stem of a needle, shown in transverse cross-section;

FIG. 11 is an axial sectional view of the disengagement of the article, by means of the pick-up body, from the needles of the machine used to produce it;

FIG. 12 is an axial sectional view of the pick-up body during the spacing of the article from the machine used to produce it;

FIG. 13 is an axial sectional view of the positioning of the pick-up body at a handling device arranged in the station for further work, which is spaced from the machine used to produce the article;

FIG. 14 is an axial sectional view of the pick-up body, arranged at the handling device during the passage of the article from the pick-up body to the handling device;

FIG. 15 is an axial sectional view of the spacing of the pick-up body from the station for further working of the article after the article has been released onto the handling device.

WAYS OF CARRYING OUT THE INVENTION

Figure 1:
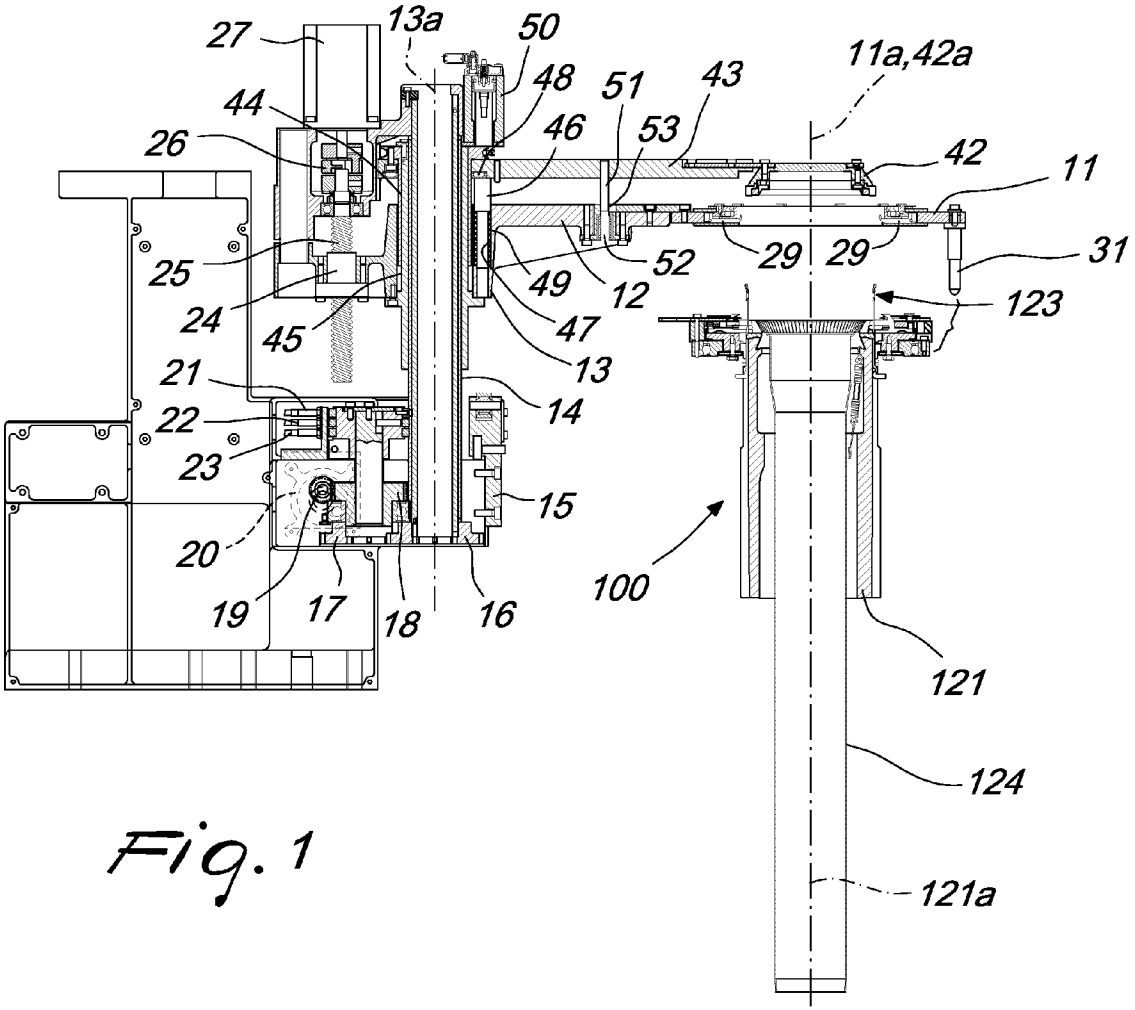
Figure 1A:
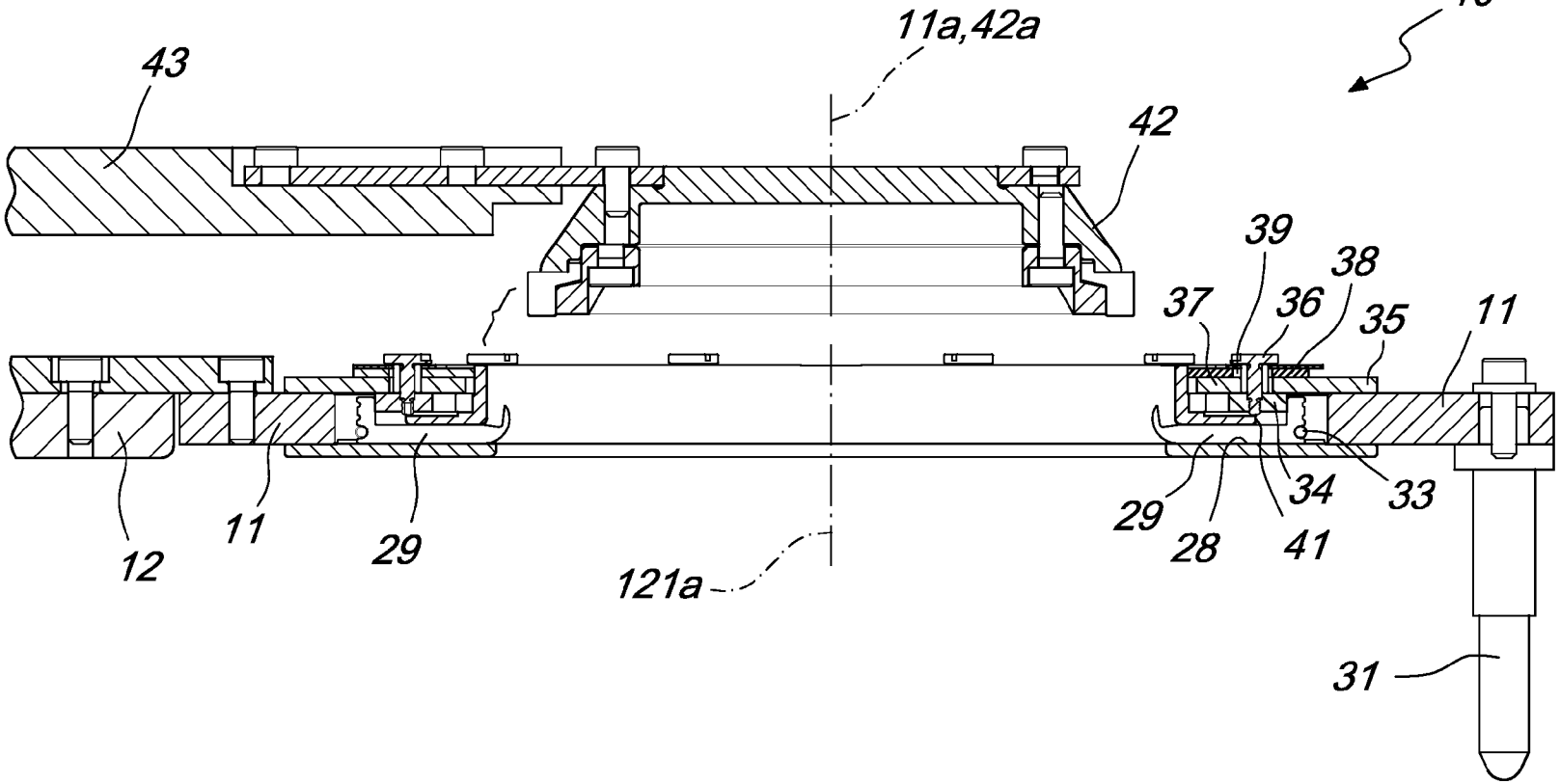
FIG. 1*a* is an enlarged-scale view of a detail of FIG. 1.

The device according to the invention is shown in its application to a single-cylinder circular hosiery knitting machine, generally designated by the reference numeral 100, but can also be used to pick up an article 101 from the needles arranged in the lower needle cylinder of a double-cylinder circular hosiery knitting machine or even to pick up an article from the needles arranged in the upper needle cylinder of a double-cylinder circular hosiery knitting machine. In this last case, however, the device according to the invention must be installed upside down with respect to what is shown in the accompanying figures.

With reference to the figures, the single-cylinder circular hosiery knitting machine 100, designed to be served by the pick-up device according to the invention, comprises a needle cylinder 121, with an axis 121*a* that is oriented vertically. On the lateral surface of the needle cylinder 121 there is a plurality of axial slots 122, inside each of which a needle 123 is accommodated which can be actuated with a reciprocating motion along the corresponding axial slot 122 in order to form knitting.

Within the needle cylinder 121 there is, in a per se known manner, a suction tube 124, which is coaxial to the needle cylinder 121. This suction tube 124, whose upper end is open and goblet-shaped, can move along the axis 121*a* with respect to the needle cylinder 121 so that it can protrude, for a portion of its extent, from the upper end of the needle cylinder 121.

The needles 123 are actuated in a per se known manner, for example by means of cams, not shown for the sake of simplicity, which are arranged around the needle cylinder 121 and can engage, upon rotation of the needle cylinder 121 about its own axis 121*a* with respect to said cams, the heels 123*a* of the needles 123 that protrude radially from the lateral surface of the needle cylinder 121. The machine 100, being a machine substantially of a known type, is not described further for the sake of simplicity.

With reference to the figures, the pick-up device according to the invention, generally designated by the reference numeral 10, comprises an annular pick-up body 11, which supports pick-up members 29 which can slide along radial directions with respect to the pick-up body 11. The pick-up body 11 can be arranged coaxially around the needle cylinder 121 of a circular knitting machine 100 so that each one of the pick-up members 29 faces laterally a corresponding needle 123 of the machine 100.

The pick-up device 10 comprises actuation means which act on the pick-up members 29 to produce their movement toward or away from the axis 11*a* of the pick-up body 11 so as to engage or disengage each pick-up member 29 with respect to the needle 123 that it is made to face, and each one of the pick-up members 29 is adapted to pick up the loop of knitting of the article 101 retained on the needle 123, as will become better apparent hereinafter.

According to the invention, the end 29*a* of each of the pick-up members 29 that is directed toward the axis 11*a* has a seat 30, which can engage a region of the stem 123*b* of the needle 123 that is arranged proximate to the latch 123*d* of the needle 123 on the opposite side with respect to the head 123*c*, and the actuation means comprise elastic means that act on the pick-up members 29 to cause their sliding toward the axis 11*a* and radial pushers 34 that act on the pick-up members 29 to cause their sliding away from the axis 11*a* in contrast with the action of the elastic means.

More particularly, the pick-up body 11 is arranged so that its axis 11*a* lies vertically and is fixed to the end of an arm 12, which is arranged horizontally and is connected, by means of its opposite end, to a sleeve 13 that has a vertical axis 13*a*. The sleeve 13 is fitted coaxially around a hollow shaft 14 and is jointly connected thereto in rotation about its own axis 13*a*. The hollow shaft 14 is supported, so that it can rotate about its own axis 13*a*, by a supporting structure 15, which can be constituted by the very supporting structure of the machine 100 or by an autonomous supporting structure that optionally can be associated with the supporting structure of the machine 100.

A gear 16 is keyed onto the hollow shaft 14 and meshes with a gear 17 that is coaxial and jointly connected to a helical gear 18, which is coupled to a worm gear 19 that is fixed to the output shaft of an electric motor 20 that is supported by the supporting structure 15.

Substantially, the actuation of the electric motor 20 causes the rotation of the arm 12 about the axis 13*a*, which constitutes a vertical actuation axis for the arm 12, with respect to the supporting structure 15, producing the passage of the pick-up body 11 from a pick-up position, in which it is arranged coaxially to the needle cylinder 121 of the machine 100, to a release position, in which it is arranged at a station for further work 102, which is constituted for example by a sewing or looping station, and vice versa, in which the unit adapted to perform additional work on the article 101 is arranged, as will become better apparent hereinafter.

Preferably, it is possible to stop rotation of the arm 12 in a standby or intermediate position arranged between the pick-up position and the release position cited above.

The three positions, which can be assumed by the pick-up body 11 following the actuation of the electric motor 20, are controlled by three sensors 21, 22, 23, which detect references arranged on the block that supports the gear 17 and the helical gear 18.

The sleeve 13, with the arm 12 connected thereto, can move on command along the axis 13*a* with respect to the hollow shaft 14. More particularly, the sleeve 13 is jointly connected to a lead screw 24, which has a vertical axis and with which a threaded shaft 25 mates which is connected, by means of a coupling 26, to the output shaft of an electric motor 27, which is supported by a block that is fixed to the hollow shaft 14.

In this manner, an actuation of the electric motor 27 causes the lifting or lowering of the arm 12 in any angular position of the arm 12 about the axis 13*a*.

The pick-up body 11 of the pick-up device 10 has a plurality of radial slots 28, within each of which a pick-up member 29 is accommodated slidlingly.

Figure 8:
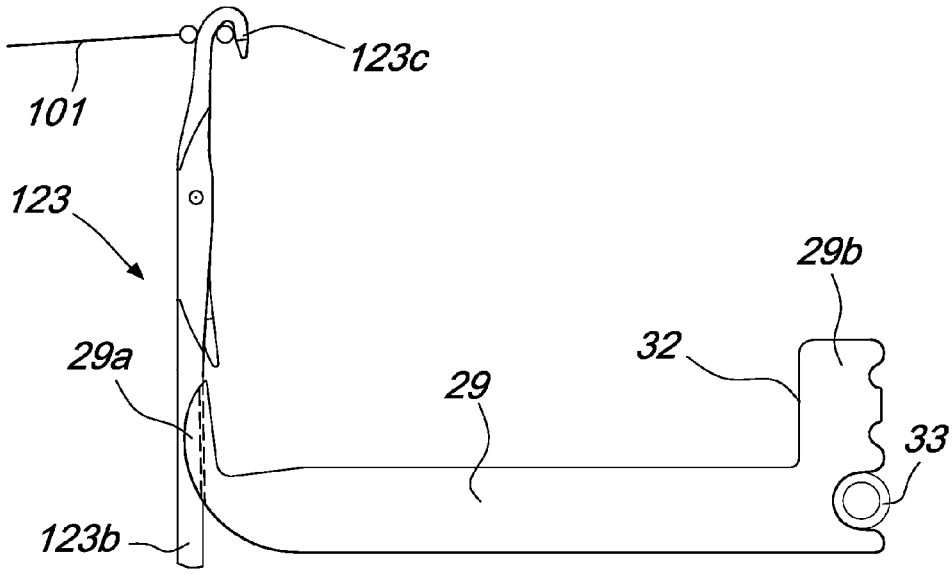
Figure 9:
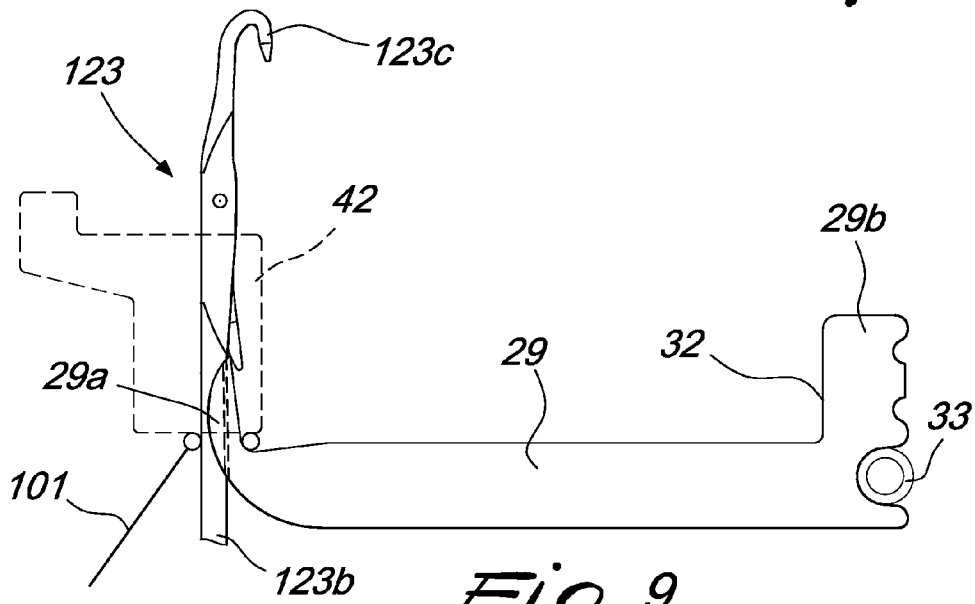
Figure 10:
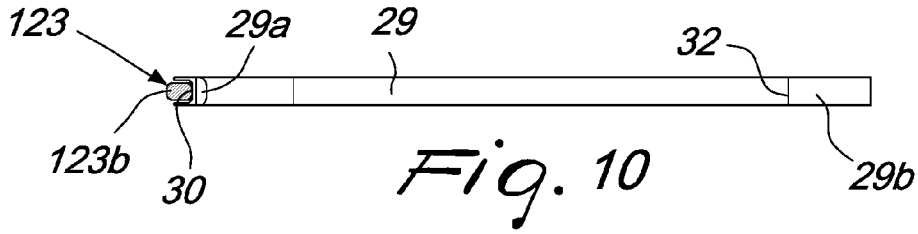

Each pick-up member 29, as shown in particular in FIGS. 8, 9 and 10, has a laminar body, which is arranged on a radial plane with respect to the axis 11*a* of the pick-up body 11. The end of each pick-up member 29 that is directed toward the axis 11*a* has a seat 30, which is open both toward the axis 11*a* and parallel to said axis 11*a*, i.e., both at the top and at the bottom. This seat 30, when the pick-up body 11 is in the pick-up position, can be coupled to the stem 123*b* of a needle 123 that the pick-up member 29 faces.

More particularly, the pick-up body 11 of the pick-up device 10 carries a number of pick-up members 29 that matches the number of needles 123 of the machine 100, and said pick-up members 29 are angularly spaced around the axis 11*a* of the pick-up body 11 so as to correspond to the angular spacing, around the axis 121*a* of the needle cylinder 121, between the needles 123 of the machine 100. Moreover, the pick-up body 11, in a peripheral region, has a centering pin 31, which has a vertical axis and which, by means of the lowering of the arm 12, which can be performed by means of the electric motor 27, can be inserted in a corresponding centering seat, which is provided in the supporting structure of the machine 100 laterally with respect to the needle cylinder 121 and is not shown for the sake of simplicity. The coupling between the centering pin 31 and the corresponding centering seat ensures precise positioning of the pick-up body 11 and of the pick-up members 29 with respect to the needle cylinder 121 of the machine 100. Appropriately provided control members, usually provided in modern circular knitting machines for hosiery or the like, allow precise angular positioning of the needle cylinder 121 about its own axis 121*a* with respect to the supporting structure of the machine and therefore allow to position each needle 123 of the machine in radial alignment with the seat 30 of a corresponding pick-up member 29 when required.

The centering pin 31 can be disengaged from the corresponding centering seat by lifting the arm 12 to allow the rotation of the arm 12 about the axis 13*a*.

Each pick-up member 29 rests, with one of its sides, against the bottom of a corresponding radial slot 28 and protrudes from it in the direction of the axis 11*a* with its end in which the seat 30 is provided. It should be noted that the seat 30 can be delimited laterally by two mutually opposite walls, as in the illustrated embodiment, but can also be delimited only on one side by a single wall.

Preferably, the end 29*a* of each pick-up member 29 is shaped like a hook that is open upwardly and the seat 30 is provided on the back of the hook.

The end 29*b*, which lies opposite the end 29*a*, of each pick-up member 29 is heel-shaped, extends parallel to the axis 11*a* and protrudes upwardly from the corresponding radial slot 28 of the pick-up body 11, so as to define a shoulder 32 that is directed toward the axis 11*a*. The elastic means that push the pick-up members 29 toward the axis 11*a* act against the side of this heel that is directed away from the axis 11*a*. Said elastic means are preferably constituted by an annular helical spring 33, whose axis coincides with the axis 11*a* and which is arranged around the pick-up members 29 and acts on the side of the heel-shaped end 29*b* that lies opposite the shoulder 32.

The radial pushers 34 are arranged in the pick-up body 11 and act on command on the shoulder 32 so as to cause the sliding of the pick-up members 29 away from the axis 11*a* in contrast with the action of the helical spring 33.

More particularly, the pick-up body 11 is closed in an upward region by a fixed plate 35, which is annular and is arranged concentrically to the axis 11*a*. Inside the pick-up body 11 there are five radial pushers 34, which are shaped like annular sectors and face the shoulder 32 of the pick-up members 29. Each one of the radial pushers 34 is fixed to a pair of pins 36, which are mutually angularly spaced around the axis 11*a* and are oriented parallel to the axis 11*a*. These pins 36 pass slidingly through first slots 37 provided in the fixed plate 35. The pairs of first slots 37 with which the pins 36 of a same radial pusher 34 engage are parallel one another and are oriented so as to allow the corresponding radial pusher 34 to move radially toward and away from the axis 11*a*. A movable plate 38 is arranged above the fixed plate 35 and is likewise annular and arranged concentrically to the axis 11*a* and is supported, so that it can rotate about the same axis 11*a*, by the pick-up body 11. The movable plate 38 is crossed by second slots 39, one for each pin 36, each of which is crossed slidingly by a pin 36. The second slots 39 are inclined with respect to the first slots 37 so that a rotation of the movable plate 38 about the axis 11*a* with respect to the pick-up body 11 and the fixed plate 35 causes a movement of the radial pushers 34 toward or away from the axis 11*a*.

The movable plate 38 is connected to the shank of the piston of a double-acting fluid-actuated, particularly hydraulic, cylinder 40, which forms plate actuation means mounted on the arm 12 and can be actuated to cause the rotation of the movable plate 38 about the axis 11*a* with respect to the pick-up body 11.

Figure 2:
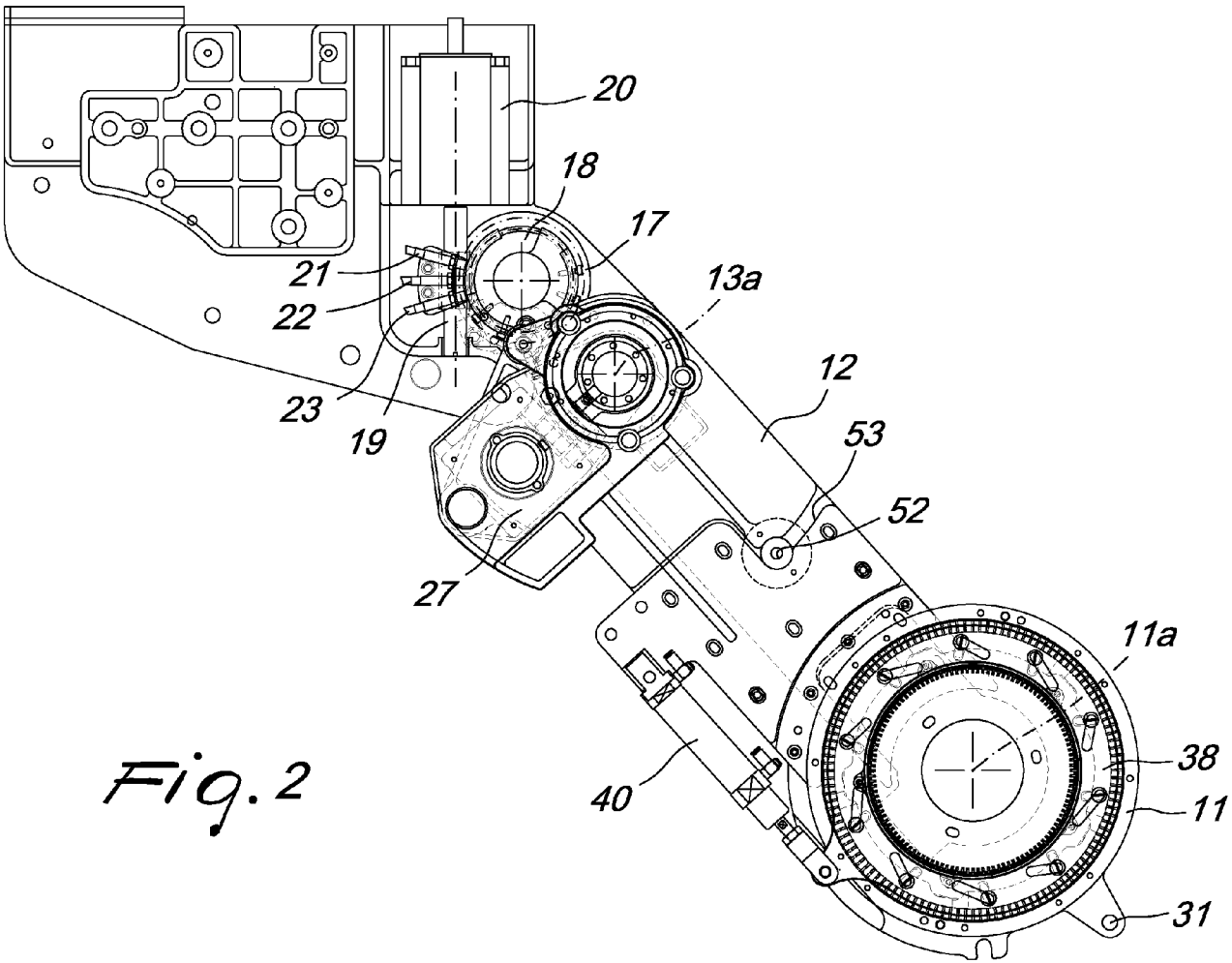
FIG. 2 is a schematic enlarged-scale top plan view of the pick-up device in the position shown in FIG. 1, with some parts shown in phantom lines and in dot-and-dash lines.
Figure 2A:
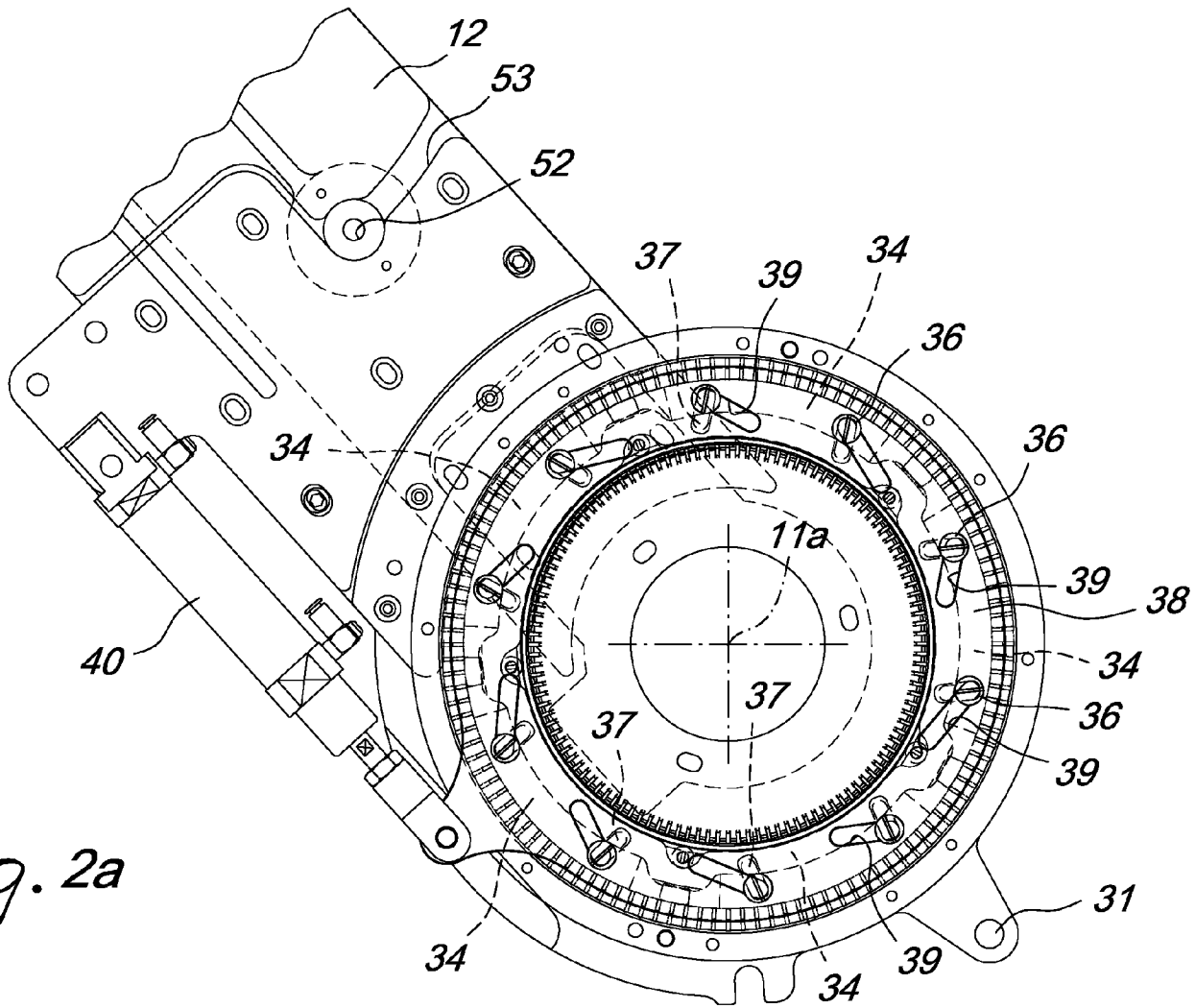
FIG. 2*a* is an enlarged-scale view of a detail of FIG. 2.
Figure 4:
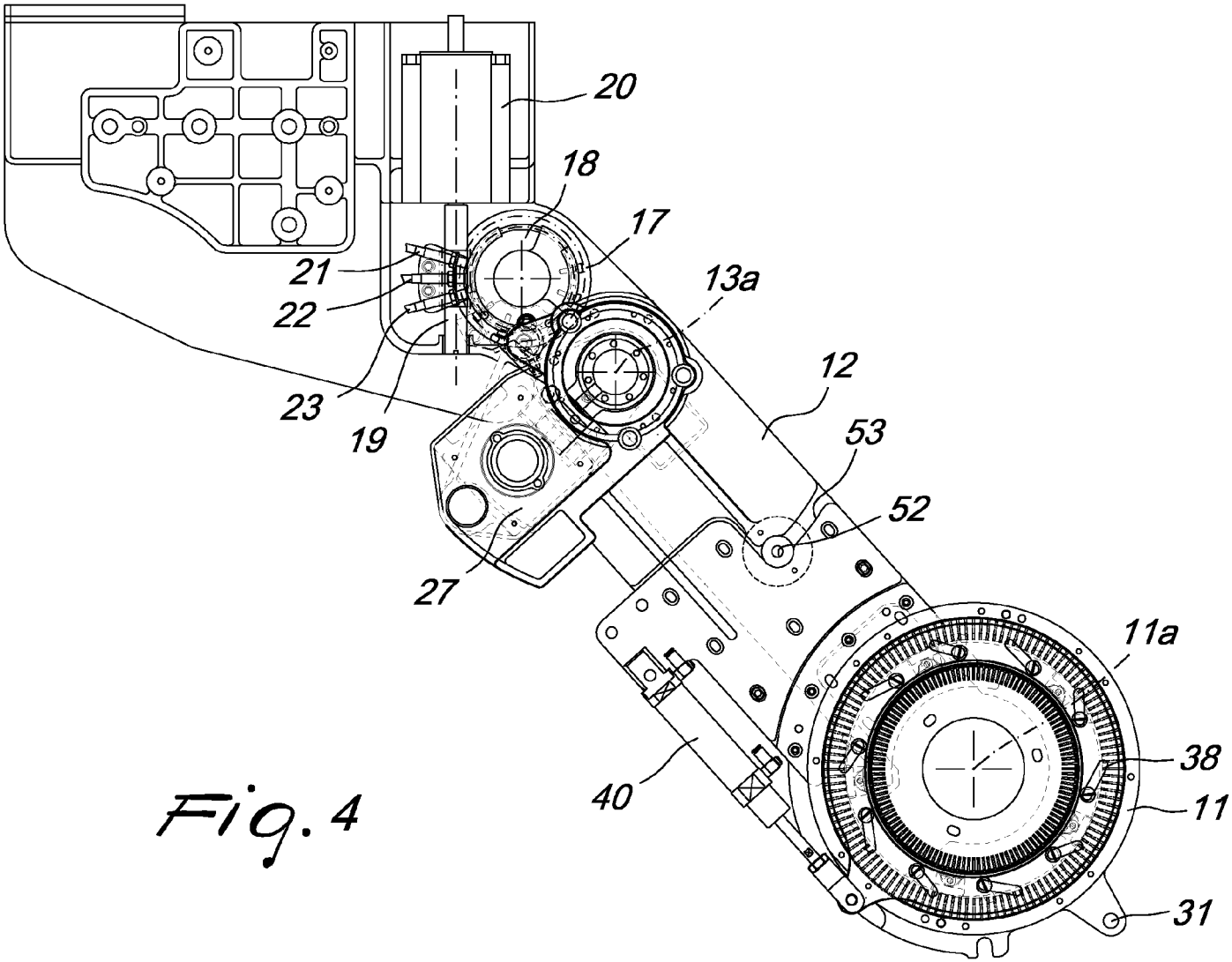
FIG. 4 is a schematic enlarged-scale top plan view of the pick-up device in the position shown in FIG. 3.
Figure 4A:
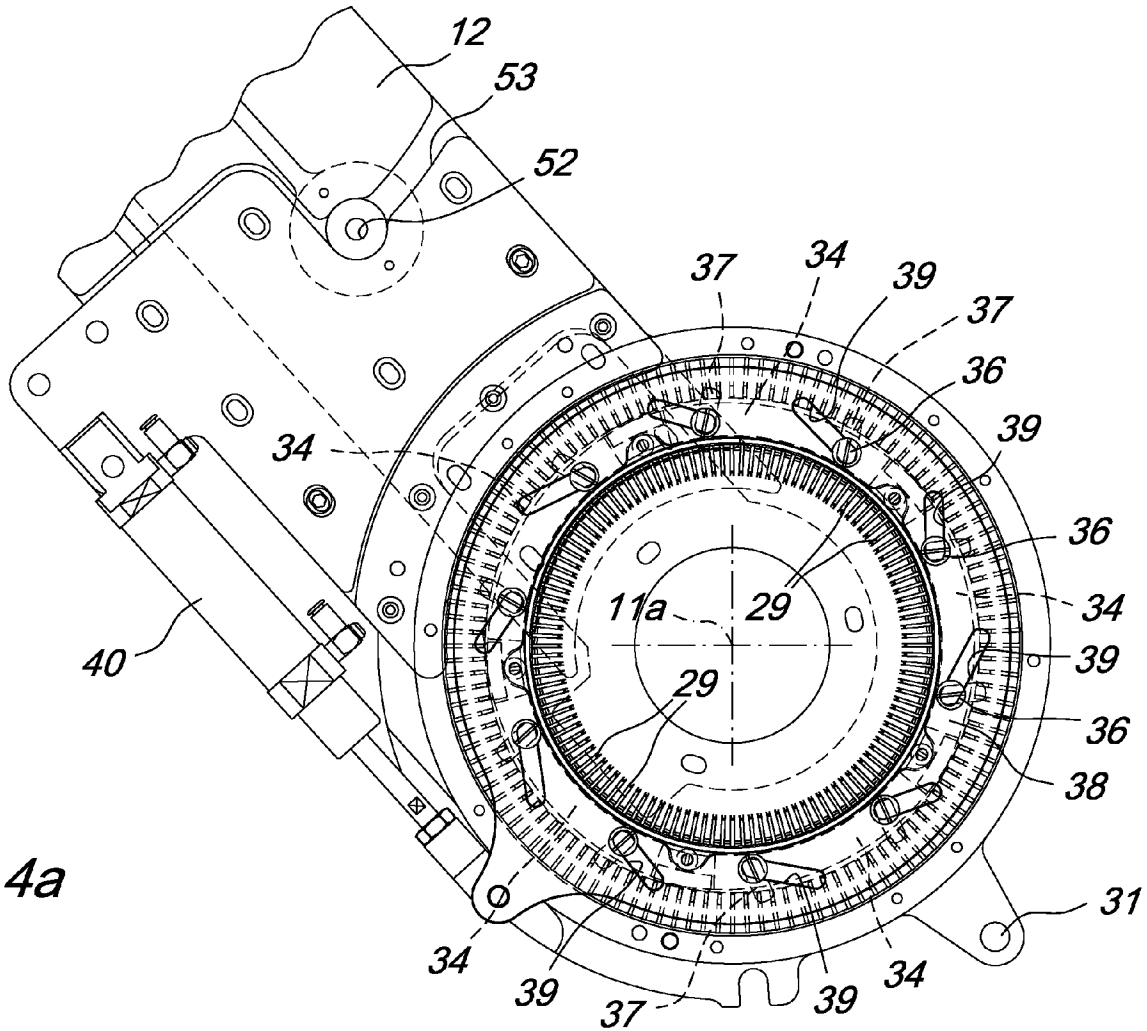
FIG. 4*a* is an enlarged-scale view of a detail of FIG. 4.

In practice, the actuation of the hydraulic cylinder 40 causes the rotation of the movable plate 38 about the axis 11*a* with respect to the pick-up body 11 in one direction, actuating the spacing of the radial pushers 34 and therefore of the pick-up members 29 from the axis 11*a* in contrast with the action of the helical spring 33, as shown in particular in FIGS. 2, 2*a*, or in the opposite direction, actuating the approach of the radial pushers 34 to the axis 11*a*, allowing the movement of the pick-up members 29 toward said axis 11*a* by way of the action of the helical spring 33, as shown in particular in FIGS. 4, 4*a*. The stroke of the pick-up members 29 toward the axis 11*a* is delimited by means for delimiting the stroke constituted by a shoulder 41 that lies opposite the shoulder 32 and is formed inside the pick-up body 11 or by the radial pushers 34 themselves.

It should be noted that each pick-up member 29 engages the stem 123*b* of the corresponding needle 123 by way of the action of the spring 33. As a consequence of this fact, a sort of adaptation of the stroke of each pick-up member 29 in the direction of the axis 11*a* to the actual radial position of the corresponding needle 123 is achieved. In practice, the particular actuation of the pick-up members 29 makes the coupling of each pick-up member 29 to the corresponding needle 123 less critical, since it can obviate imprecise radial positionings of the needles 123, ensuring in any case a precise coupling. Moreover, the particular actuation of the pick-up members 29, in addition to allowing excellent containment of the axial space occupation of the pick-up body 11 as a whole, also allows to use a same pick-up device 10 with machines that have the same number of needles but are arranged along cylindrical surfaces that have slightly different diameters.

The pick-up device 10 also comprises a presser 42, which has a circular plan shape with a comb-shaped peripheral profile with a plurality of teeth arranged around the vertically oriented axis 42*a* of the presser 42.

The presser 42 is connected to an end of a corresponding arm 43, which, in the illustrated embodiment, is arranged above the arm 12. The arm 43 is connected, by means of its opposite end, to a corresponding sleeve 44, which is arranged coaxially to the sleeve 13 and is coupled, so as to be able to rotate about the axis 13*a* and slide along said axis 13*a*, in a cylindrical seat 45 formed in the sleeve 13.

The arm 43 rests against the upper end of columns 46 which have a vertical axis, are arranged around the axis 13*a* and are accommodated, so that they can slide axially, in corresponding seats 47 followed by the sleeve 13. The arm 43 rests on the columns 46 by means of a bearing 48, whose axis coincides with the axis 13*a*, so as to reduce the sliding of the arm 43 on the columns 46 during a rotation of the arm 43 with respect to the arm 12 about the axis 13*a*.

The columns 46 are pushed toward the arm 43, and therefore upwardly in the illustrated embodiment, by springs 49 which are interposed between the columns 46 and the corresponding seats 47.

The sleeve 13 supports a fluid-actuated cylinder 50, which has a vertical axis and rests with the shank of its piston against the sleeve 44. In practice, the fluid-actuated cylinder 50 is jointly connected to the sleeve 13 in rotation about the axis 13*a* and in translational motion along said axis 13*a* and can be actuated to produce the translational motion, in a downward direction in the illustrated embodiment, of the sleeve 44 and therefore of the arm 43 along the axis 13*a* with respect to the arm 12 in contrast with the action of the springs 49.

The arm 43, on its side directed toward the arm 12, is provided with a pin 51, which has a vertical axis and which, by means of the translational motion of the arm 43 with respect to the arm 12 along the axis 13*a*, can be inserted in a seat 52, which has a vertical axis and is provided in the arm 12, or can be extracted from said seat 52.

The coupling of the pin 51 to the seat 52 ensures the coaxial positioning of the presser 42 with respect to the pick-up body 11 and at the same time jointly connects the arm 12 and the arm 43 and therefore the presser 42 and the pick-up body 11 in rotation about the axis 13*a*.

Figure 3:
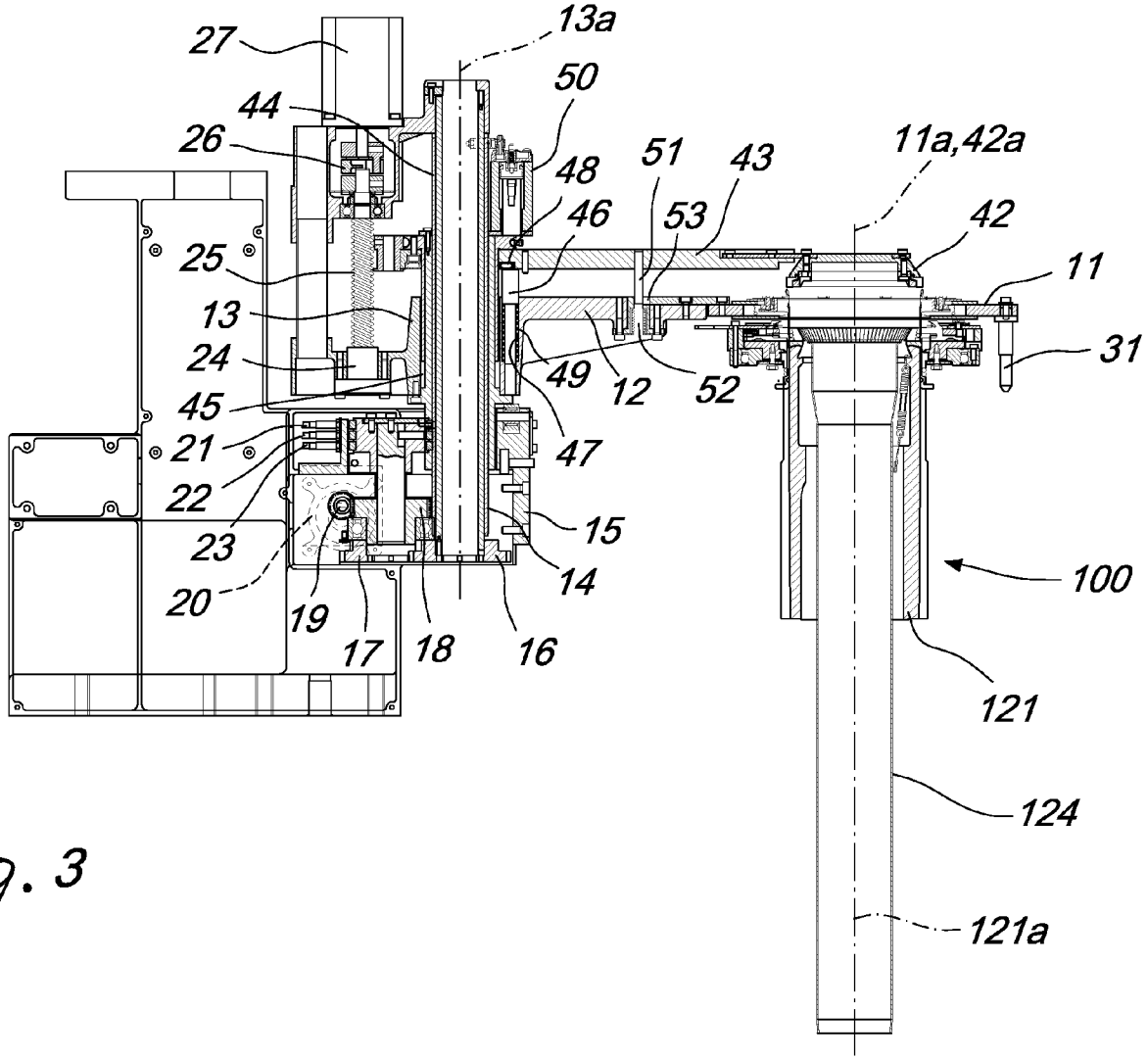

The inlet of the seat 52 is formed on the bottom and at a closed end of a slot 53 formed on the face of the arm 12 that is directed toward the arm 43. The slot 53 is shaped like a circular sector that is centered on the axis 13*a* and is open at an end thereof that lies opposite with respect to the end occupied by the seat 52. In the condition of maximum spacing of the arm 43 above the arm 12, the lower end of the pin 51 is at such a level as to disengage from the seat 52 but be able to engage the slot 53, as shown for example in FIGS. 1 and 3. In this manner, in the condition of maximum spacing of the arm 43 above the arm 12, the arm 12 can rotate about the axis 13*a* with respect to the supporting structure 15, disengaging from the arm 43 in one direction, because the pin 51 protrudes from the open end of the slot 53, while in rotating in the opposite direction it engages the arm 43, because the pin 51 enters the same open end of the slot 53, engaging it, as will become better apparent hereinafter.

Figure 5:
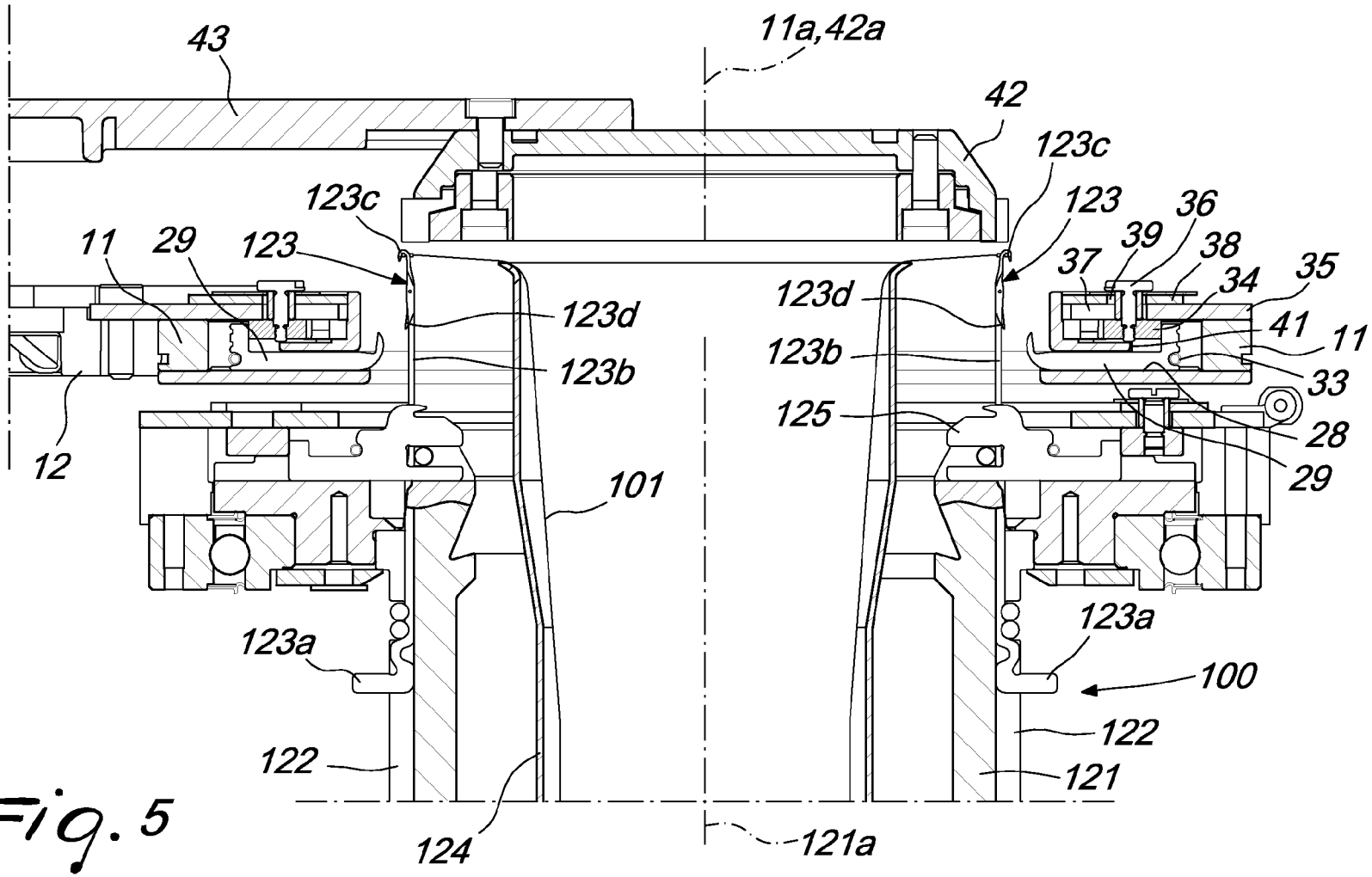
FIGS. 5 to 15 are schematic views of the operation of the pick-up device according to the invention during the pick-up of an article from the machine used to produce it and its positioning in a station for further work on the article, more particularly.
Figure 6:
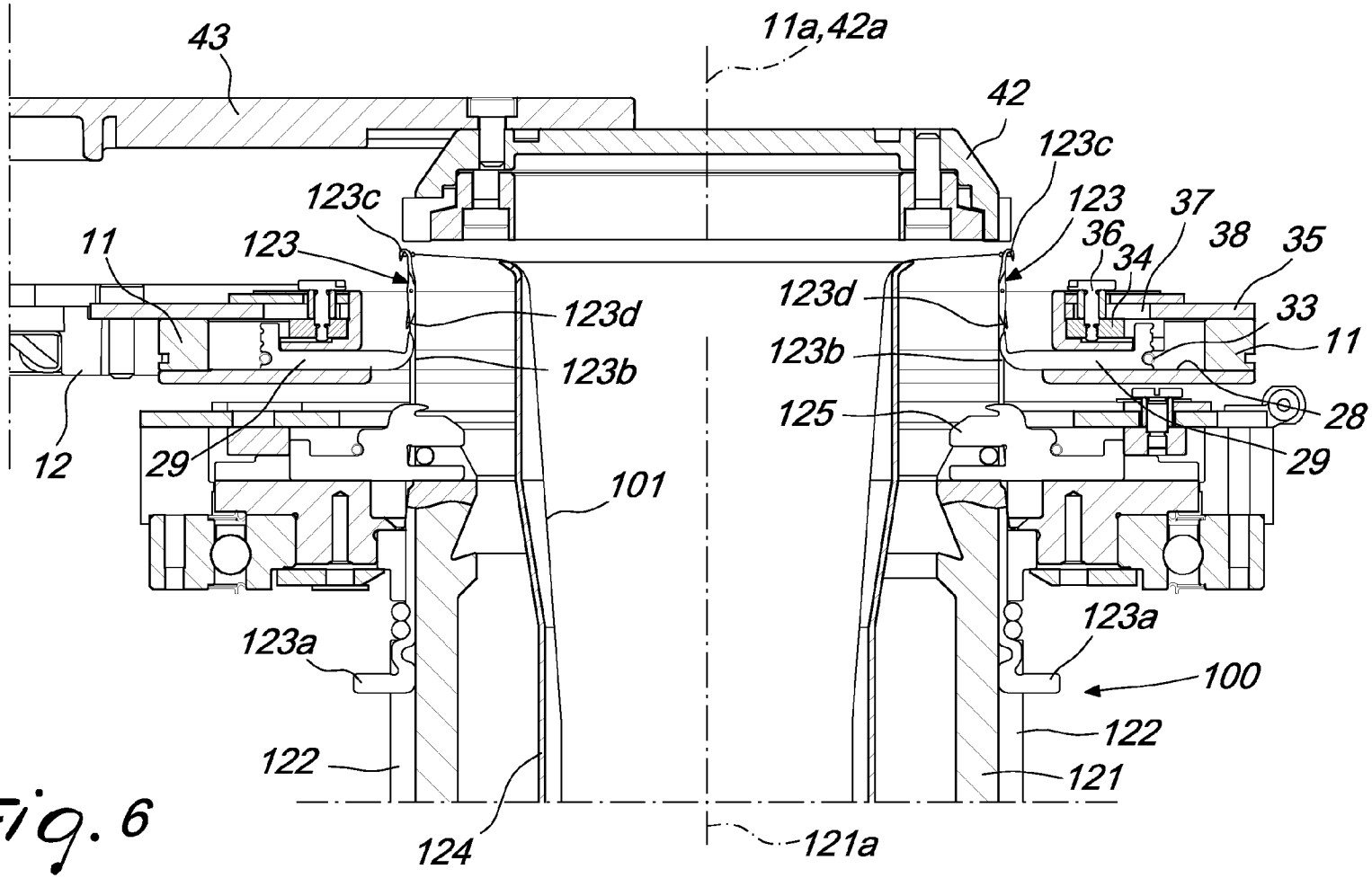
Figure 7:
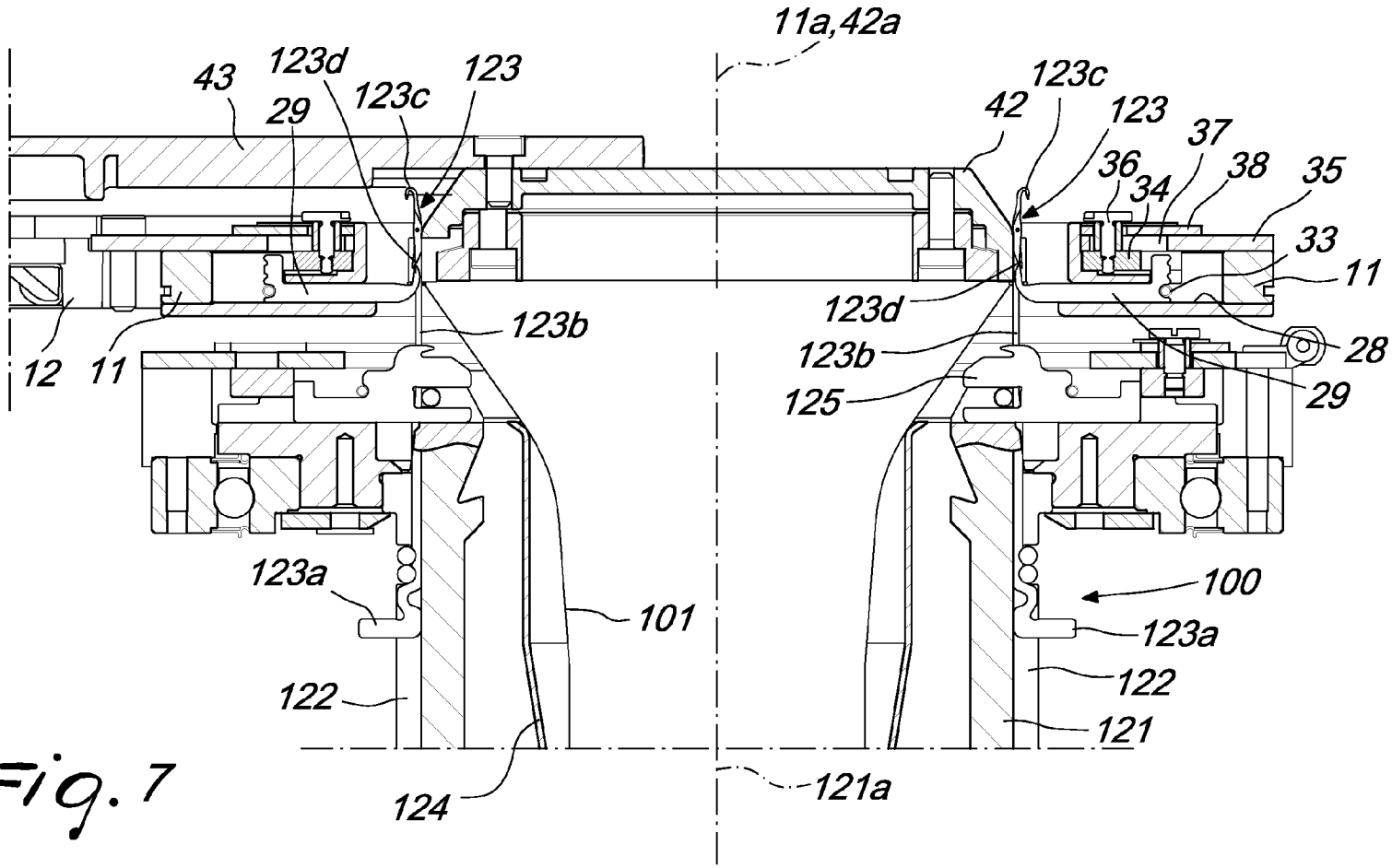
Figure 11:
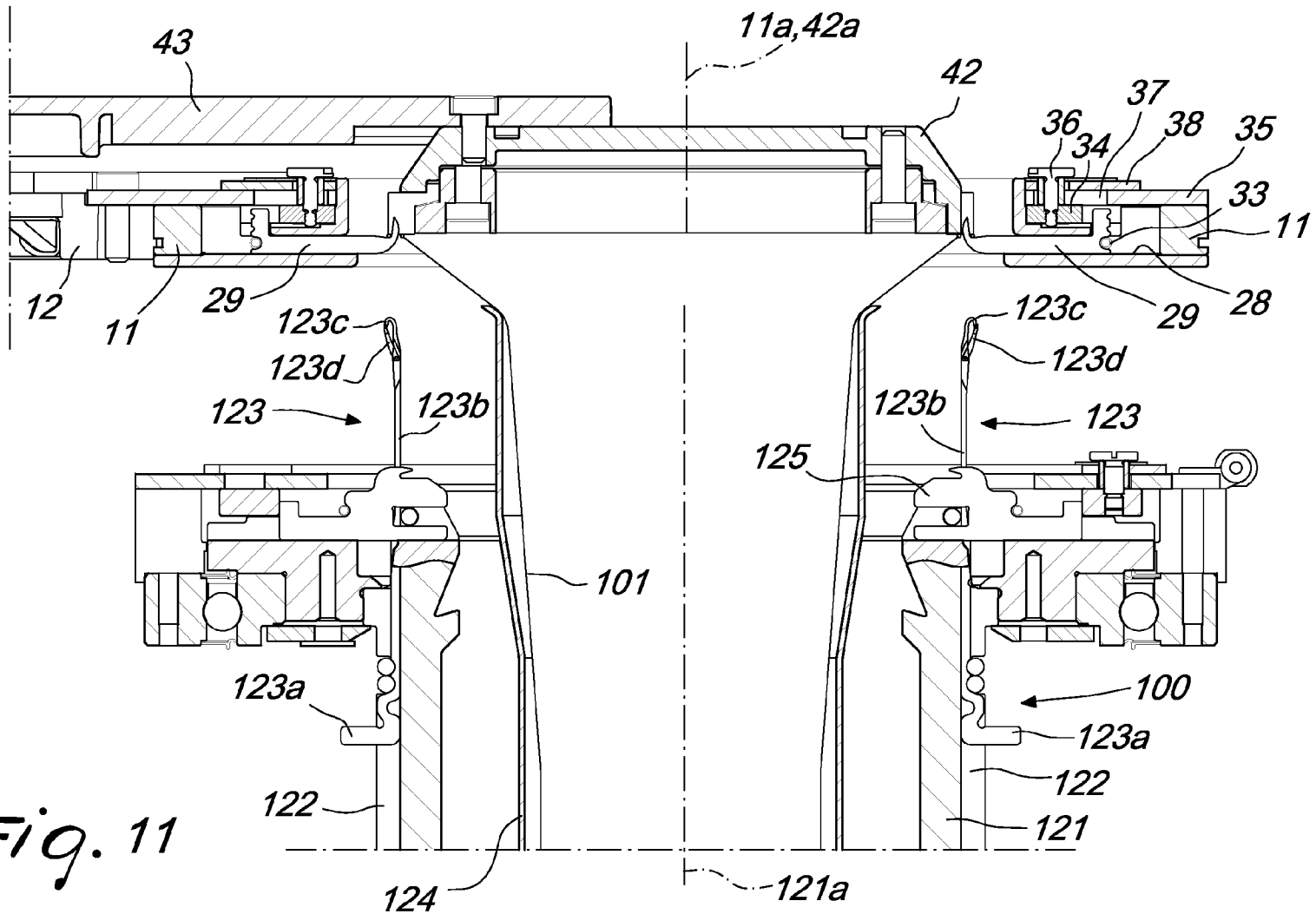
Figure 12:
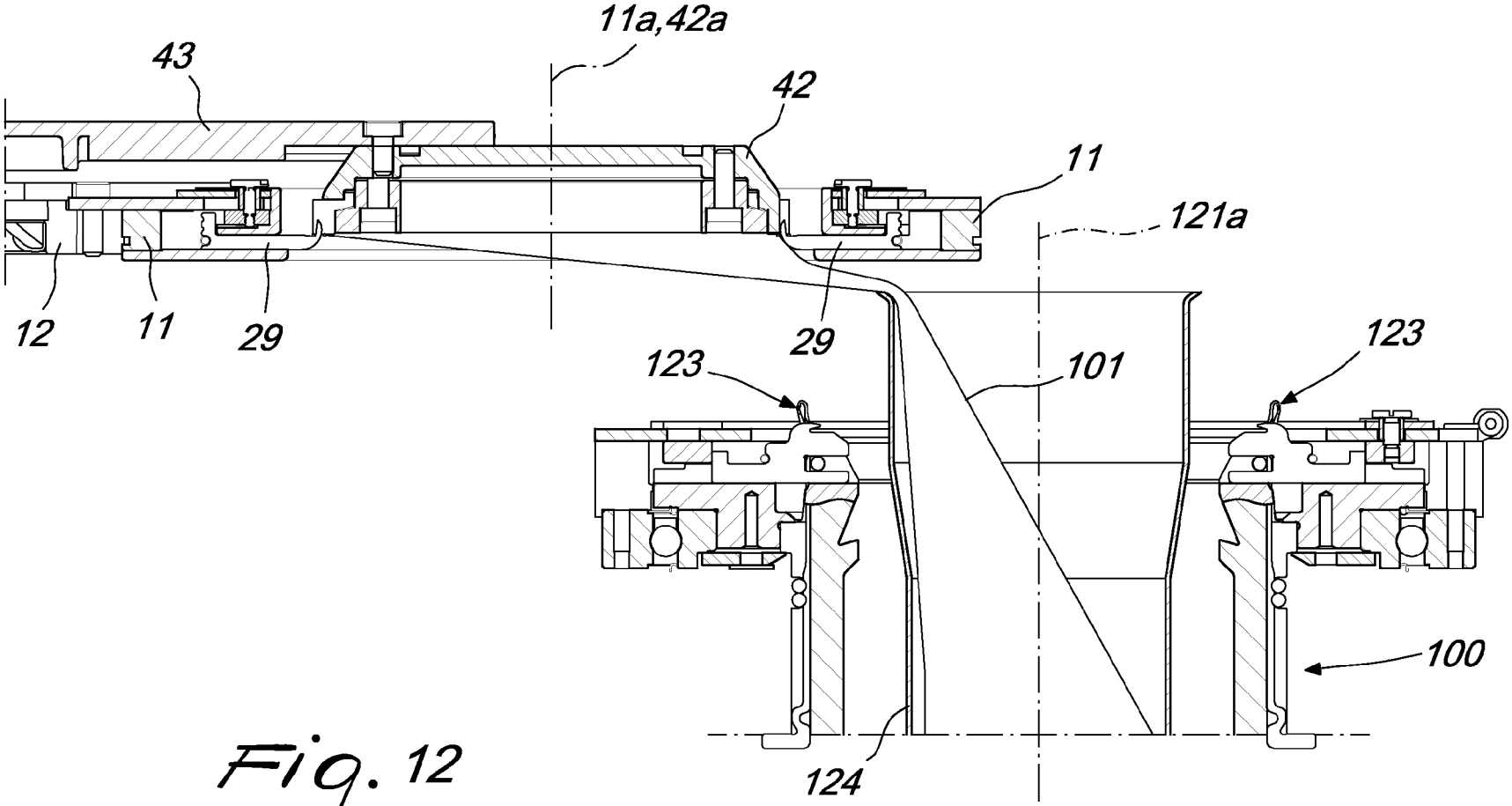

The presser 42, particularly when it is in a coaxial position with respect to the pick-up body 11, can move by way of the actuation of the fluid-actuated cylinder 50, from a raised position, in which it is spaced upwardly from the pick-up body 11, as shown for example in FIGS. 1, 1*a*, 3, 5 and 6, to a lowered position, in which it penetrates, with the teeth of its peripheral profile, between the pick-up members 29, as shown for example in FIGS. 7, 11 and 12.

Along the path followed by the arm 43 in its rotation about the axis 13*a* there is an abutment 54, which stops the rotation of the arm 43 in the raised position in a position that corresponds substantially to the intermediate position of the arm 12 between the machine 100 and the station for further work 102, preventing the arm 43 from following the arm 12 in the station for further work 102. Vice versa, when the arm 12 rotates about the axis 13*a* from the station for further work 102 to the machine 100 and reaches the intermediate position in which it previously released the arm 43, the pin 51 enters the slot 53 and, at its end, i.e., when the pin 51 is coaxial to the seat 52, it entrains in its rotation toward the machine 100 the arm 43.

In the station for further work 102 it is possible to provide a handling device 60, which is provided with an annular body 61 arranged so that its axis 61*a* is vertical. The body 61 is provided, on its lower face, with a plurality of spikes 62, which are arranged along an imaginary cylindrical surface whose axis coincides with the axis 61*a* and protrude parallel to said axis 61*a*. The spikes 62 are angularly spaced one another about the axis 61*a* uniformly with an angular spacing that corresponds to the spacing that exists between the pick-up members 29 of the pick-up device 10. In practice, a spike 62 of the handling device 60 corresponds to each pick-up member 29, and when the pick-up device 10 is positioned in the station for further work 102, the pick-up body 11 of the pick-up device 10 is arranged coaxially to the body 61 of the handling device 60, with the pick-up members 29 arranged around the ring of spikes 62 and with each pick-up member 29 aligned radially with a spike 62.

The seat 30, provided in the end of each pick-up member 29 that is directed toward the axis 11*a* and engageable with a needle of the machine 100, can be coupled likewise with a spike 62 by means of an axial movement of the pick-up body 11 and by means of a radial movement of the pick-up members 29 with respect to the spikes 62.

The body 61 can be composed, in a per se known manner, of two half-rings 63*a*, 63*b*, which are pivoted one another about a diametrical axis 64. One of the two half-rings, constituted by the half-ring 63*b*, can be overturned on command with respect to the other half-ring 63*a* about the diametrical axis 64 so that each spike 62 of the half-ring 63*b* faces a corresponding spike 62 of the half-ring 63*a*. In the illustrated embodiment, when the two half-rings 63*a*, 63*b* are in a coplanar position, the spikes 62 are directed so that their tip is downward and the half-ring 63*b* can be overturned about the diametrical axis 64 so as to face in a downward region the half-ring 63*a*.

At the station 102 an annular body 151 is also provided, which can be accommodated coaxially in an annular seat 150 whose axis coincides with the axis 61*a*. The annular body 151 is connected to the shank of the piston of a fluid-actuated cylinder, not shown, which is oriented so that it axis lies parallel to the axis 61*a*. This fluid-actuated cylinder can be actuated in order to move in one direction or in the opposite direction the annular body 151 along the axis 61*a*.

The peripheral profile of the face of the annular body 151 that is directed upwardly is preferably comb-shaped, with teeth that can be inserted between the pick-up members 29 of the pick-up device 10 when the pick-up body 11 is moved into the station for further work 102.

Operation of the pick-up device according to the invention is as follows.

The article 101 is produced on the circular knitting machine for hosiery or the like, beginning its production from one axial end and ending it at the opposite axial end.

While the machine 100 is ending the production of the article 101, the pick-up device 10 is arranged so that its pick-up body 11 is in the intermediate position between the machine 100 and the station for further work 102, with the pick-up members 29 spaced from the axis 11*a* of the pick-up body 11. The presser 42 is arranged upwardly and coaxially with respect to the pick-up body 11 and is raised with respect thereto.

Each loop of knitting of the last row of knitting that is formed is retained on the needle 123 that produced it. The dial, not shown for the sake of simplicity, which is arranged above and coaxially with respect to the needle cylinder 121, after the cutter jointly connected to the dial has cut the yarn used to produce the article 101, is moved away in an upward direction from the needle cylinder 121 in order to allow the positioning, above and coaxially with respect to the needle cylinder 121, of the pick-up body 11 of the pick-up device 10 with the corresponding presser 42 arranged upward and coaxially with respect to the pick-up body 11, as shown in FIG. 5.

It should be noted that the pick-up device 10 is arranged so that the pick-up body 11 lies above the needle cylinder 121 and is thus lowered along the axis 11*a*, which coincides with the axis 121*a*, by way of the actuation of the electric motor 27, so that the centering pin 31 enters the appropriately provided seat provided in the supporting structure of the machine 100.

The needle cylinder 121 continues to be actuated with a rotary motion about its own axis 121*a* so that the needles 123, by way of the needle actuation cams, are first raised into the held stitch position and then returned with their head 123*c* below sinkers 125 to be then raised again to the held stitch position, simultaneously lifting the suction tube 124 so that the loops of knitting of the last row of knitting of the article 101 that have been formed are assuredly in the head 123*c* of the corresponding needle 123 with the latches 123*d* of the needles 123 open. Finally, the needles 123, again by means of the rotation of the needle cylinder 121 with respect to the needle actuation cams, are all raised into the dropped stitch position together with the suction tube 124. At this point, the rotation of the needle cylinder 121 is stopped and the needle cylinder 121 is locked mechanically so as to exclude random or accidental rotation thereof during subsequent steps. In this rotational position of the needle cylinder 121, the end 29*a* of each pick-up member 29 that is directed toward the axis 11*a* is radially aligned with the stem 123*b* of a corresponding needle 123.

At this point, the fluid-actuated cylinder 40 is actuated and, by turning the movable plate 38, moves the radial pushers 34 toward the axis 11*a*, thus allowing the pick-up members 29 to move toward the axis 11*a* by way of the action of the thrust applied by the spring 33, as shown in FIGS. 4, 4*a*. The end of each pick-up member 29 that is directed toward the axis 11*a* rests with the seat 30 against the stem 123*b* of the corresponding needle 123 directly below the latch 123*d* of said needle 123, as shown in FIG. 6 and more particularly in FIGS. 8 and 10, which illustrate exclusively the coupling of a pick-up member 29 with a needle 123.

After the engagement of the pick-up members 29 against the stem 123*b* of the corresponding needle 123, the pick-up body 11 is raised slightly, by way of the actuation of the electric motor 27, so that the end 29*a* of each pick-up member 29 engages, by means of the seat 30, the stem 123*b* of the needle 123 between the free end of the open latch 123*d* of a needle 123 and the stem 123*b* of said needle 123.

The suction tube 124 is then lowered and, by way of the actuation of the fluid-actuated cylinder 50, the presser 42 is moved to the lowered position, in which it penetrates, with the teeth of its peripheral profile, between the needles 123 and between the pick-up members 29. As a consequence of this axial movement of the presser 42, the loops of knitting are pushed into the hook-shaped end 29*a* of the pick-up members 29 below the latches 123*d* of the needles 123, as shown in FIGS. 7 and 9. Moreover, the pin 51 engages the seat 52, jointly connecting the arm 12 and the arm 43 in a rotation about the axis 13*a*.

The pick-up body 11 of the pick-up device 10 is then raised along its own axis 11*a* with respect to the needle cylinder 121 together with the presser 42 by way of the actuation of the electric motor 27. This lifting, by way of the sliding toward the head 123*c* of the corresponding needle 123 of the pick-up members 29 previously arranged with their end 29*a* below the open latch 123*d* of the corresponding needle 123, causes the closure of the latches 123*d* on the heads 123*c* of the needles 123 and the disengagement of the loops of knitting from the needles 123, as shown in FIG. 11.

In this step, the suction tube 124 is lifted again to assist the rise of the article 101 and protect the article 101 from contact with the portions of the machine that are arranged around the needles 123 in the subsequent step.

By way of the actuation of the electric motor 20, the arms 12 and 43 are then rotated about the axis 13*a* so as to transfer the pick-up body 11 of the pick-up device 10 and the presser 42 from the machine 100 to the intermediate position between the machine 100 and the station for further work 102, as shown in FIG. 12. In this intermediate position, the fluid-actuated cylinder 50 is deactivated so that the arm 43 that supports the presser 42 disengages with its pin 51 from the seat 52.

Figure 13:
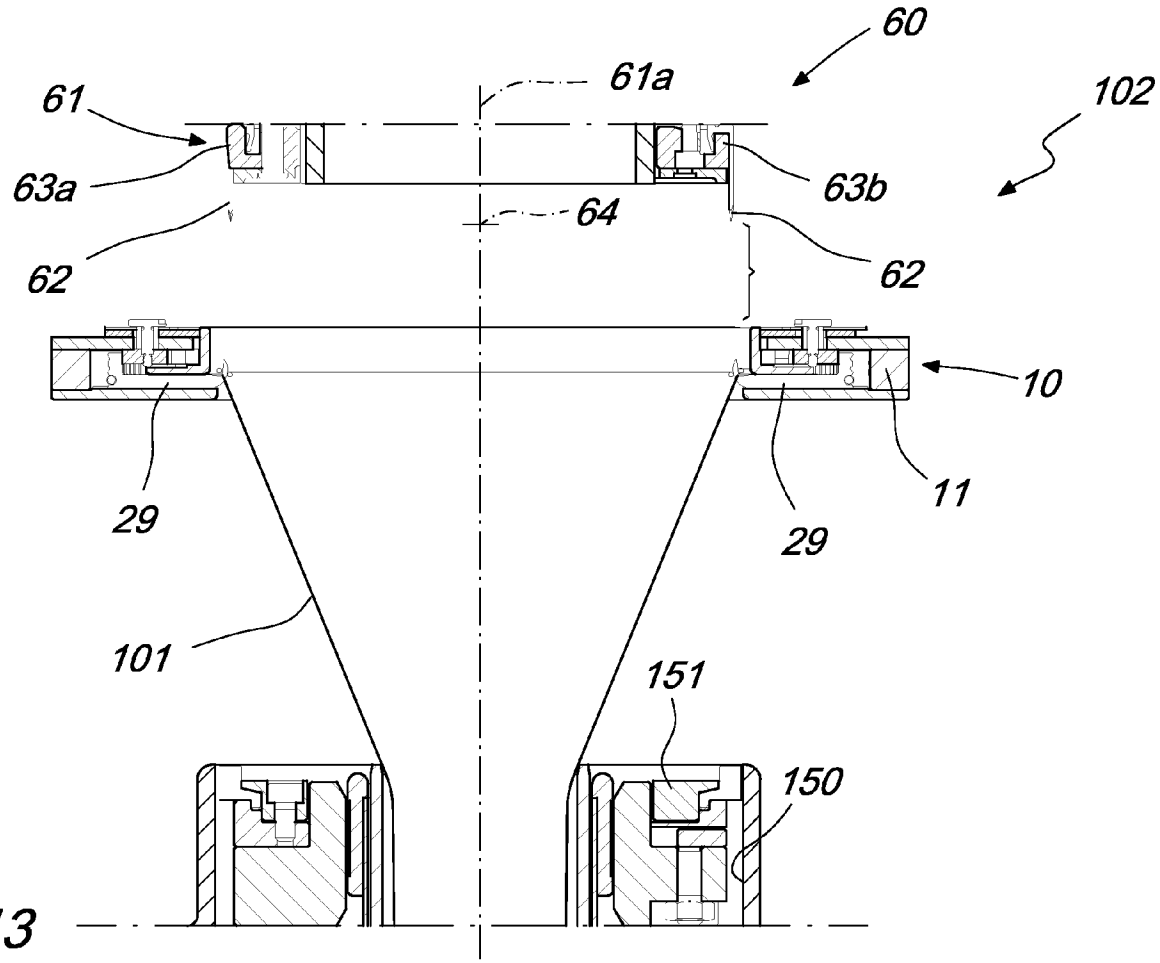

The rotation of the arm 12 about the axis 13*a* by way of the electric motor 20 is then completed until the pick-up body 11 lies with its axis 11*a* at the axis 61*a* in the station for further work 102, as shown in FIG. 13. It should be noted that in completing the rotation of the arm 12 about the axis 13*a* the arm 43 does not follow the arm 12, because its rotation is blocked by the abutment 54 and the slot 53 runs along the pin 51, disengaging from it. Optionally, in this position the article 101 can be aspirated pneumatically in a tubular body that is arranged below and coaxially with respect to the pick-up body 11.

The pick-up body 11, which lies below the two half-rings 63*a*, 63*b*, which are mutually coplanar, is then raised by way of the actuation of the electric motor 27 so that each seat 30 of the pick-up members 29 fits onto a spike 62, starting from its lower end.

Figure 14:
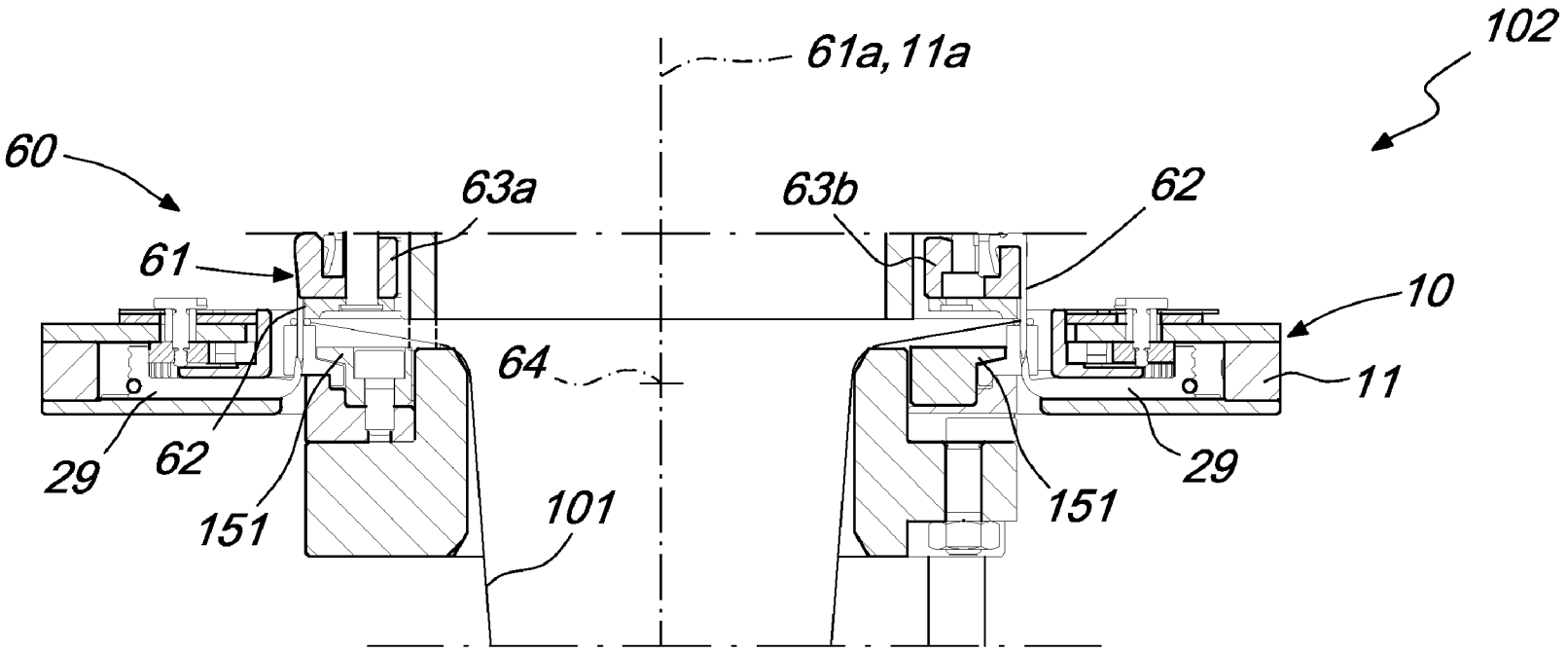

The annular body 151 is then lifted along the axis 61*a* and enters with the teeth of its peripheral profile between the pick-up members 29, causing the individual passage of the loops of knitting from the pick-up members 29 to the spikes 62. In this manner, each spike 62 supports a loop of knitting of the last row of knitting formed by the needles 123 of the machine 100, as shown in FIG. 14.

At this point, the article 101 can be overturned above the body 61, making it pass axially through it, in a per se known manner, for example by pneumatic suction or by means of an overturning tube that can be inserted axially through the body 61.

Figure 15:
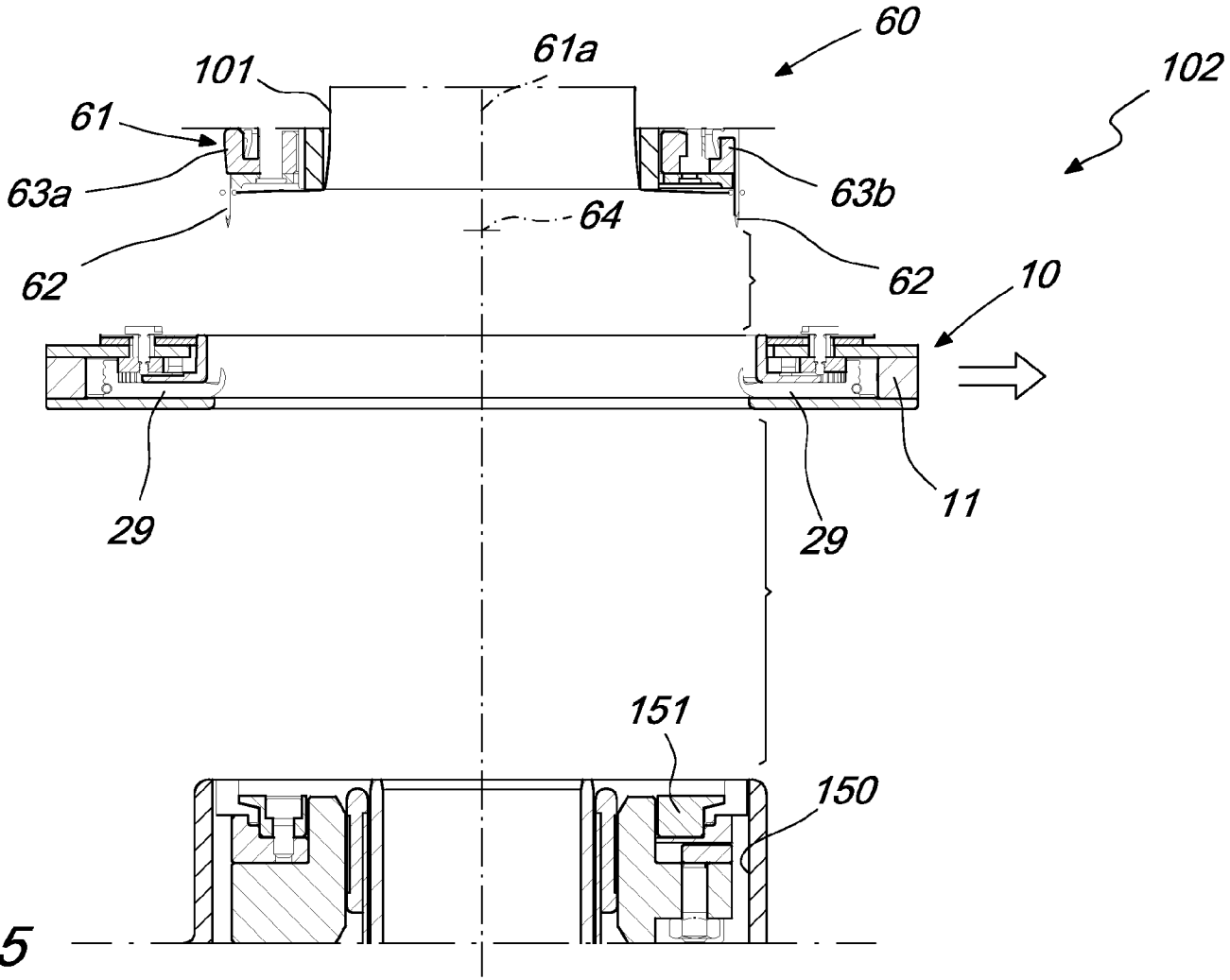

The annular body 151 is then returned to the lowered position and the pick-up body 11 of the pick-up device 10 is moved away from the station for further work 102 and returned to the intermediate position by way of a downward motion that is caused by the actuation of the electric motor 27 and by way of a rotation about the axis 13*a* that is caused by the actuation of the electric motor 20, as shown in FIG. 15.

In the station for further work 102, work on the article 101 can continue, in a per se known manner, for example by arranging the loops of knitting that belong to one half-row so that they face the loops of knitting that belong to the other half-row by overturning the half-ring 63*b* below the half-ring 63*a* and by means of the passage of the loops of knitting from the spikes 62 of the half-ring 63*a* to the spikes 62 of the half-ring 63*b*, followed by a sewing of the pairs of loops of knitting arranged on the spikes 62 of the half-ring 63*b*, thus closing an axial end of the article 101.

In practice it has been found that the pick-up device according to the invention fully achieves the intended aim, since the particular coupling between the pick-up members and the needles in combination with the particular actuation of the pick-up members toward the axis of the pick-up body actuated by elastic means ensures precise coupling between the pick-up members and the needles, which is also capable of compensating radial positioning errors of the needles.

A further advantage of the pick-up device according to the invention is that it can have a reduced axial space occupation for the pick-up body and therefore can require minimal lifting of the dial, if it is used on a single-cylinder circular machine, or of the upper needle cylinder, if it is used on a double-cylinder circular machine.

Another advantage of the pick-up device according to the invention is that it can be used to pick up articles from needles or release articles onto spikes arranged along cylindrical surfaces having different diameters.

The device thus conceived is susceptible of numerous modifications and variations, all of which are within the scope of the appended claims: all the details may further be replaced with other technically equivalent elements.

In practice, the materials used, as well as the dimensions, may be any according to requirements and to the state of the art.

The disclosures in Italian Patent Application no. MI2008A000398, from which this application claims priority, are incorporated herein by reference.

The invention claimed is:

1. A pick-up device for picking up a tubular knitted article from a circular knitting machine for hosiery and for transferring the article to a unit adapted to perform additional work thereon, comprising an annular pick-up body that supports pick-up members that can slide with respect to said pick-up body along radial directions, said pick-up body being arrangeable coaxially around a needle cylinder of a circular knitting machine for hosiery so that each one of said pick-up members faces laterally a needle of the machine; actuation means being provided which act on said pick-up members to move them toward or away from the axis of said pick-up body, for the engagement or disengagement of each pick-up member with the needle of the machine that it is made to face, and each of said pick-up members being adapted to pick up the loop of knitting retained on said needle, wherein the end of each one of said pick-up members that is directed toward the axis of said pick-up body has a seat that can engage a region of the stem of the needle that is arranged proximate to the latch of the needle on the opposite side with respect to the head of the needle, and in that said actuation means comprise elastic means that act on said pick-up members for their sliding toward the axis of said pick-up body and radial pushers that act on said pick-up members for their sliding away from the axis of said pick-up body in contrast with the action of said elastic means.

2. The device according to claim 1, wherein said pick-up body can move on command from a pick-up position, in which it is arranged coaxially around the needle cylinder of the circular knitting machine for hosiery or the like, to a release position, in which it is arranged at a station for further work that is spaced laterally with respect to the needle cylinder of the machine and in which said unit adapted to perform additional operations on the article is arranged, and vice versa.

3. The device according to claim 1, wherein said pick-up body is oriented so that its axis is vertical and is mounted on an arm that can rotate on command, with respect to a supporting structure, about a vertical actuation axis which is spaced from the axis of said pick-up body, for the passage of said pick-up body from said pick-up position to said release position or vice versa.

4. The device according to claim 3, wherein said arm can move on command along said vertical actuation axis.

5. The device according to claim 1, wherein said pick-up body has a plurality of radial slots, each of which accommodates slidingly one of said pick-up members, said pick-up body supporting said radial pushers that act on command on said pick-up members for their sliding away from the axis of said pick-up body in contrast with the action of said elastic means; means being provided for delimiting the stroke of said pick-up members toward the axis of said pick-up body.

6. The device according to claim 1, wherein an end of said pick-up members that is directed toward the axis of said pick-up body is shaped like a hook that is open upward; said seat being formed on the back of said hook.

7. The device according to claim 6, wherein the end of said pick-up members that is directed toward the axis of said pick-up body can engage, by means of said seat, the stem of the needle between the free end of the open latch of a needle and the stem of said needle.

8. The device according to claim 6, wherein the end of each one of said pick-up members that lies opposite the end that is directed toward the axis of said pick-up body is heel-shaped, extends parallel to the axis of said pick-up body and protrudes upward from, the corresponding radial slot; said heel-shaped end defining a shoulder that is directed toward the axis of said pick-up body; said radial pushers acting on said shoulder in the opposite direction with respect to the axis of said pick-up body and said elastic means acting on the side of said heel that lies opposite said shoulder.

9. The device according to claim 1, wherein said elastic means are constituted by an annular helical spring that is arranged in said pick-up body around said pick-up members.

10. The device according to claim 1, wherein each one of said radial pushers is shaped like an annular sector and supported slidingly by said pick-up body along a corresponding direction that is oriented radially with respect to said pick-up body; each one of said radial pushers being jointly connected to at least two pins, which are oriented axially with respect to said pick-up body and are spaced angularly with respect to each other about the axis of said pick-up body; said two pins engaging slidingly corresponding first slots, which are mutually parallel and are oriented so as to allow a radial movement of the corresponding radial pusher with respect to said pick-up body, and are formed in a fixed annular plate that is fixed coaxially to said pick-up body; said pins further engaging second slots, which are provided in an annular movable plate that is arranged coaxially to said pick-up body; said second slots being inclined with respect to said first slots and said movable plate being able to rotate about its own axis with respect to said pick-up body in order to produce the sliding of said pins along said first slots.

11. The device according to claim 10, comprising plate actuation means that comprise a fluid-actuated cylinder, which is mounted on said arm and is connected by means of the shank of its piston to said movable plate; said fluid-actuated cylinder being actuable in order to actuate the rotation of said movable plate about the axis with respect to said pick-up body.

12. The device according to claim 1, wherein each one of said pick-up members, with said pick-up body in said release position, can engage, by means of said seat formed in its end that is directed toward the axis of said pick-up body, a spike of a handling element, which has a plurality of spikes arranged along a cylindrical surface and is arranged in said station for further work; said pick-up body, in said release position, being arranged coaxially to the cylindrical surface along which said spikes are arranged.

13. The device according to claim 1, further comprising a presser that has a circular plan shape with a comb-like peripheral profile; said presser being able to face coaxially said pick-up body and being movable axially with respect to said pick-up body in order to penetrate with the teeth of its peripheral profile between said pick-up members.

14. The device according to claim 13, wherein said presser is mounted on a corresponding arm which can rotate jointly with, or with respect to, the arm that supports said pick-up body about said vertical actuation axis.

15. The device according to claim 14, wherein said arm that supports said presser can move jointly with, or with respect to, the arm that supports said pick-up body along said vertical actuation axis.

16. The device according to claim 1, further comprising means for centering said pick-up body with respect to the needle cylinder of the knitting machine for hosiery or the like.

17. The device according to claim 13, further comprising means for centering said presser with respect to said pick-up body.

* * * * *